US006604574B1

(12) United States Patent
Loomis et al.

(10) Patent No.: US 6,604,574 B1
(45) Date of Patent: Aug. 12, 2003

(54) TWO-PIECE HEADER AND HEAT EXCHANGER INCORPORATING SAME

(75) Inventors: Roger A. Loomis, Hernando, MS (US); Paul L. Mitchell, Scobey, MS (US)

(73) Assignee: Heatcraft Inc., Grenada, MS (US)

( * ) Notice: Subject to any disclaimer, the term of this patent is extended or adjusted under 35 U.S.C. 154(b) by 0 days.

(21) Appl. No.: 10/234,829

(22) Filed: Sep. 4, 2002

(51) Int. Cl.[7] ..... F28F 9/02

(52) U.S. Cl. ..... 165/173; 165/175; 180/68.1; 29/890.052

(58) Field of Search ..... 165/173, 175, 165/176; 29/890.052; 180/68.1; 228/183; 123/41.49

(56) References Cited

U.S. PATENT DOCUMENTS

| | | | | |
|---|---|---|---|---|
| 4,595,135 A | | 6/1986 | Wallis | |
| 4,615,385 A | | 10/1986 | Saperstein et al. | |
| 4,877,083 A | | 10/1989 | Saperstein | |
| 4,936,381 A | | 6/1990 | Alley | |
| 4,971,240 A | | 11/1990 | Wallis | |
| 4,998,580 A | | 3/1991 | Guntly et al. | |
| 5,036,914 A | * | 8/1991 | Nishishita et al. | 165/173 |
| 5,052,478 A | | 10/1991 | Nakajima et al. | |
| 5,076,354 A | | 12/1991 | Nishishita | |
| 5,092,398 A | | 3/1992 | Nishishita et al. | |
| 5,097,900 A | | 3/1992 | Yamaguchi | |
| 5,099,576 A | | 3/1992 | Shinmura | |
| 5,125,454 A | | 6/1992 | Creamer et al. | |
| 5,127,466 A | | 7/1992 | Ando | |
| 5,152,339 A | * | 10/1992 | Calleson | 165/173 |
| 5,265,672 A | | 11/1993 | Aoki | |
| 5,271,151 A | | 12/1993 | Wallis | |
| 5,348,083 A | | 9/1994 | Hosoya et al. | |
| 5,372,188 A | | 12/1994 | Dudley et al. | |
| 5,390,519 A | * | 2/1995 | Kuroda et al. | 29/890.052 |
| 5,456,006 A | | 10/1995 | Study | |
| 5,586,600 A | * | 12/1996 | Cribari | 165/173 |
| 5,656,332 A | | 8/1997 | Saito et al. | |
| 5,771,964 A | | 6/1998 | Bae | |
| 5,799,396 A | | 9/1998 | Bosch et al. | |
| 5,816,321 A | * | 10/1998 | Wijkstrom | 165/173 |
| 5,944,096 A | | 8/1999 | Hubert | |
| 6,016,864 A | | 1/2000 | Bae et al. | |
| 6,161,614 A | | 12/2000 | Woodhull, Jr. et al. | |
| 6,324,761 B1 | | 12/2001 | Mashiko et al. | |
| 6,386,277 B1 | | 5/2002 | Wattelet et al. | |

FOREIGN PATENT DOCUMENTS

| | | | | |
|---|---|---|---|---|
| JP | 5-604485 A | * | 3/1993 | 165/173 |

* cited by examiner

*Primary Examiner*—Henry Benneit
*Assistant Examiner*—Terrell McKinnon
(74) *Attorney, Agent, or Firm*—Brooks & Kushman P.C.

(57) ABSTRACT

A header (10) for a heat exchanger (1). The header (10) has an outer elongate member (20) with a curved section that has a plurality of ferrules (30) projecting inwardly. An inner elongate member (60) is adapted to mate with the outer elongate member (20). The inner elongate member (60) has first and second ends (26, 28) and a plurality of teeth (72) proximate at least one of the first and second ends (26, 22). The teeth (72) at least partially cooperate with the ferrules (30) when the outer elongate member (20) engages the inner elongate member (60). A heat exchanger (1) incorporating the two-piece headers (10) is also disclosed.

20 Claims, 4 Drawing Sheets

TWO-PIECE HEADER AND HEAT EXCHANGER INCORPORATING SAME

BACKGROUND OF THE INVENTION

1. Field of the Invention

The invention relates to a two-piece header for a heat exchanger and a heat exchanger incorporating two-piece headers.

2. Background Art

Heat exchangers frequently have two headers to facilitate the movement of fluid through passageways. The headers may be manufactured using numerous methods such as extrusion, roll forming a single piece of metal, or forming two separate pieces of metal and joining the pieces together in a subsequent operation. While the two-piece design has significant advantages over extrusion and roll-forming two separate pieces, the two-piece design lacks strength and durability. Accordingly, a need exists to develop a stronger and more durable leak-resistant two-piece header and a heat exchanger incorporating the same.

SUMMARY OF THE INVENTION

The present invention discloses a header for a heat exchanger. The header has an outer elongate member with a longitudinal, curved section. The outer elongate member has a plurality of ferrules projecting inwardly. The header also has an inner elongate member adapted to mate with the outer elongate member. The inner elongate member has longitudinal first and second ends and a plurality of teeth proximate at least one of the first and second ends. The teeth at least partially cooperate with the ferrules when the outer elongate member engages the inner elongate member to provide additional strength, ease of manufacture and assembly, and relative immunity from fluid leaks during high pressure fluid flow.

The present invention also discloses a heat exchanger having first and second two-piece headers. The headers have an outer elongate member with a longitudinal, curved section. The outer elongate member has a plurality of ferrules projecting inwardly. The headers also have an inner elongate member adapted to mate with the outer elongate member. The inner elongate member has longitudinal first and second ends and a plurality of teeth proximate at least one of the first and second ends. The teeth at least partially cooperate with the ferrules when the outer elongate member engages the inner elongate member. The heat exchanger also includes a plurality of tubes that extend between respective ferrules in the headers to provide a path for fluid to travel from one header to the other header and a plurality of fins bonded to at least some of the tubes to increase the heat exchange capability of the heat exchanger.

The above object and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT

Figure 1:
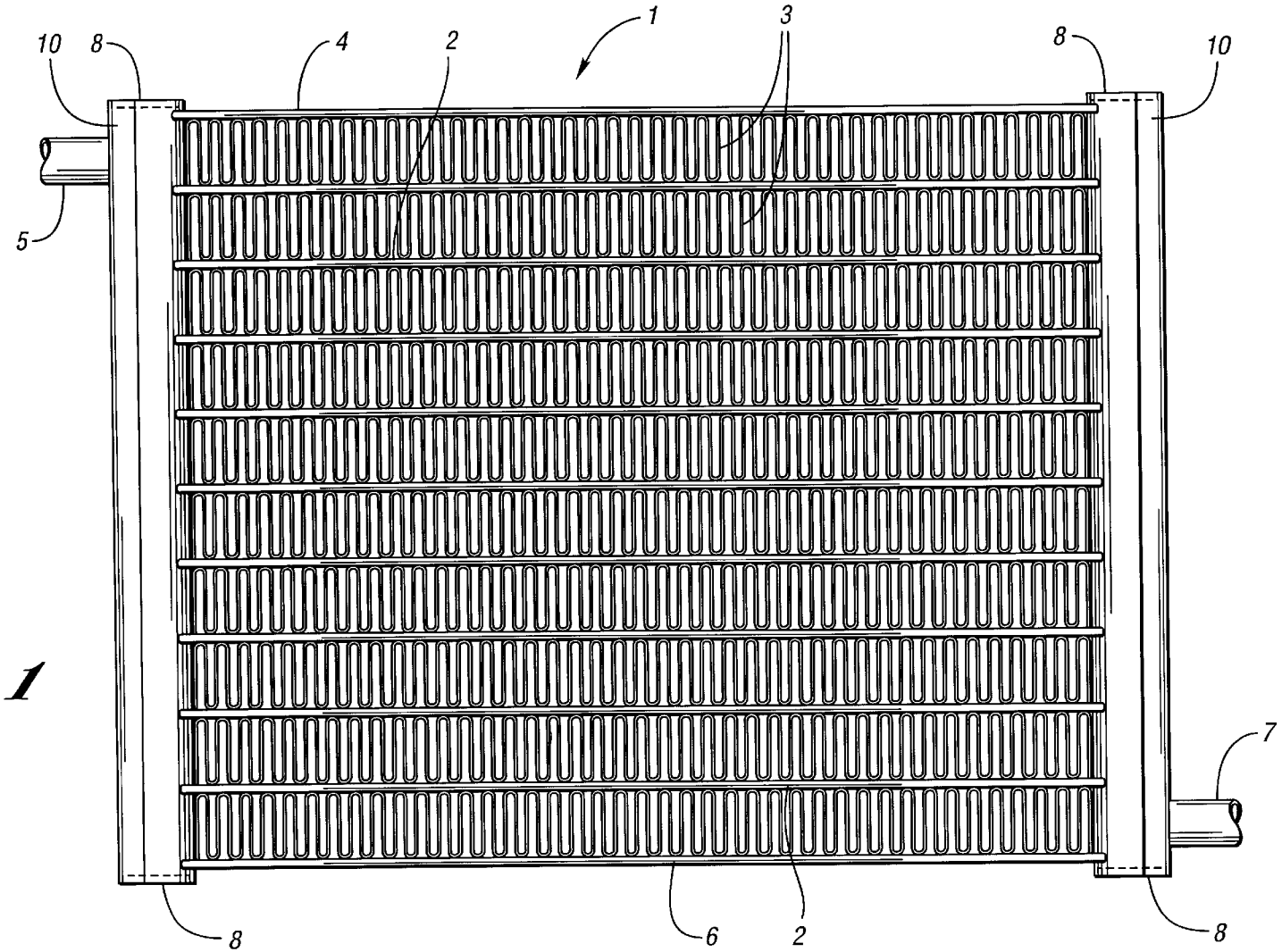
FIG. 1 is a side elevation view of a heat exchanger having the improved two-piece headers of the present invention.
Figure 2:
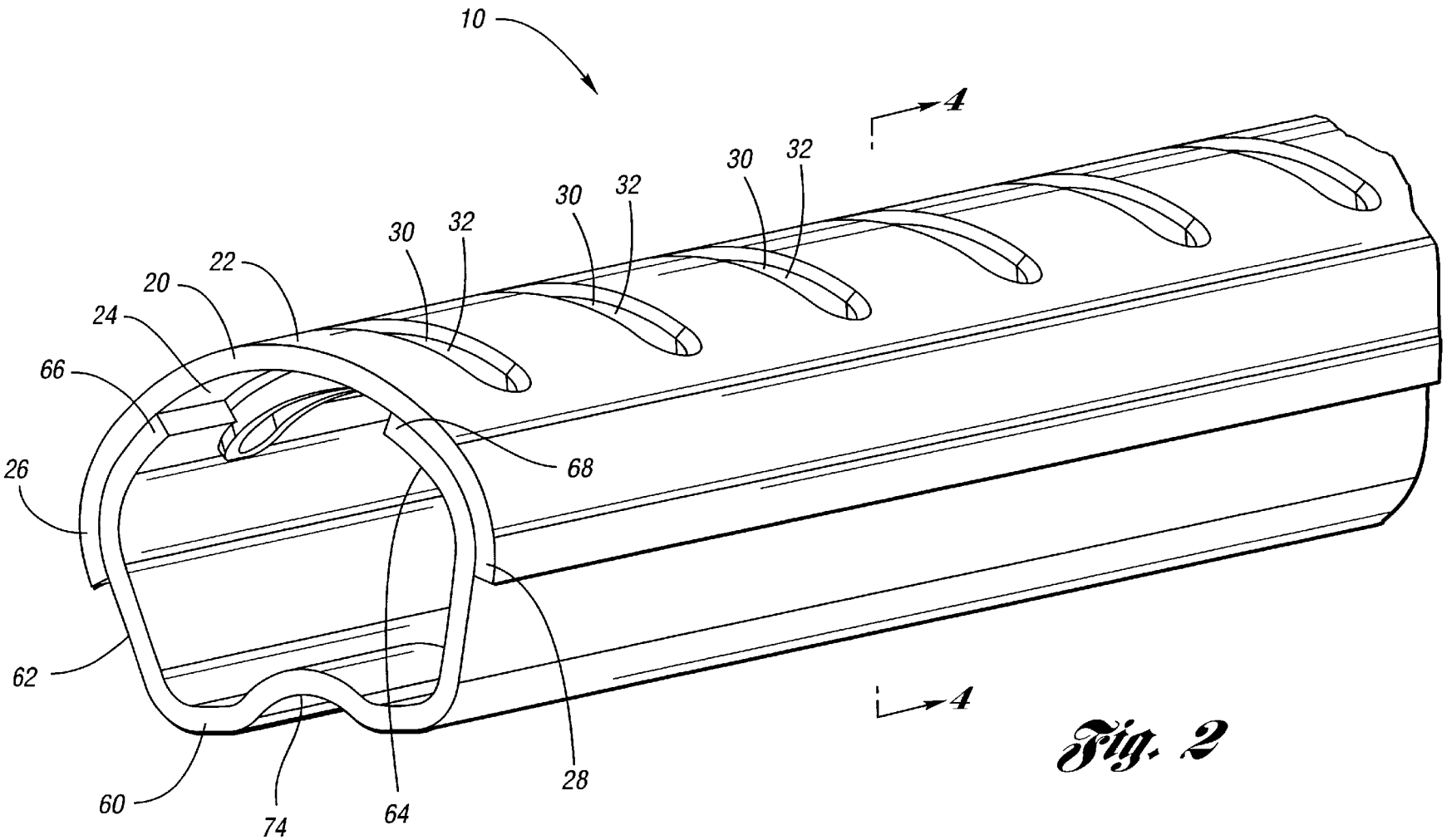
FIG. 2 is a perspective view of a two-piece header of the present invention.
Figure 3:
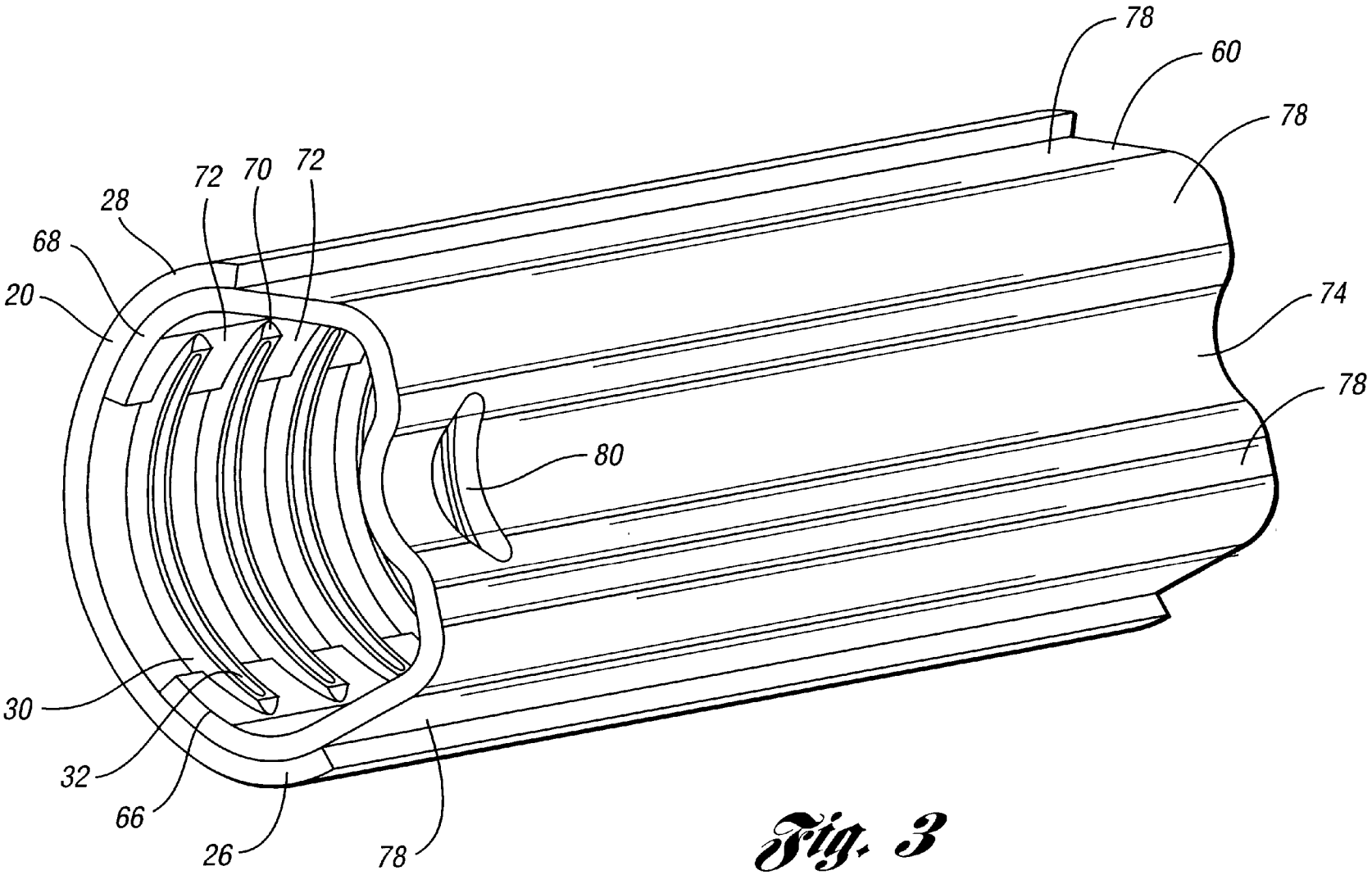
FIG. 3 is an underside perspective view of the two-piece header of the present invention.
Figure 4:
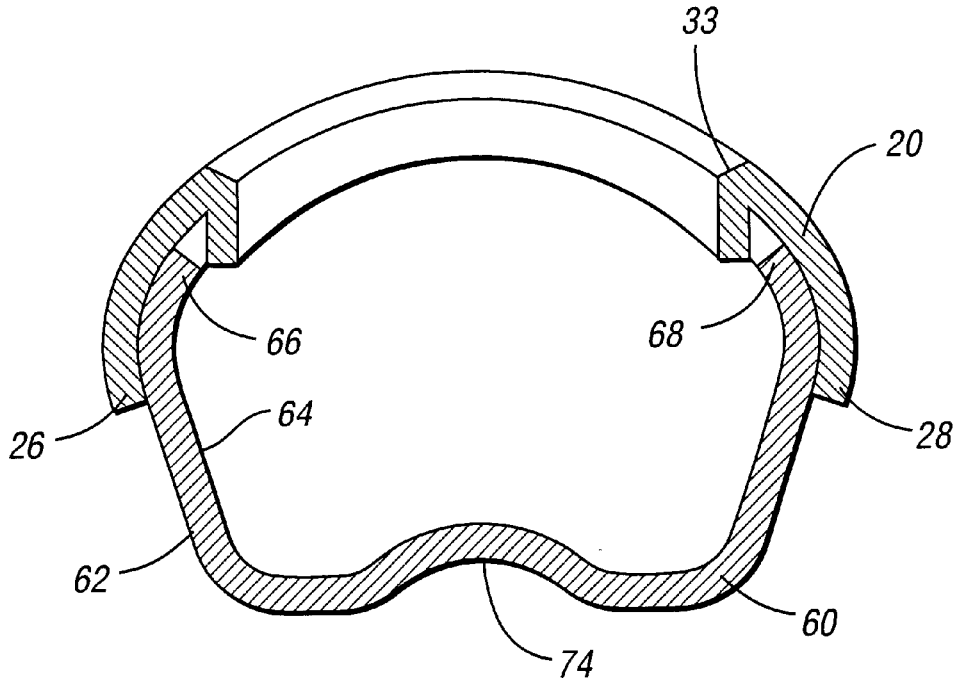
FIG. 4 is a lateral cross-section of the two-piece header of the present invention through a ferrule taken along the line 3—3 of FIG. 2.
Figure 5:
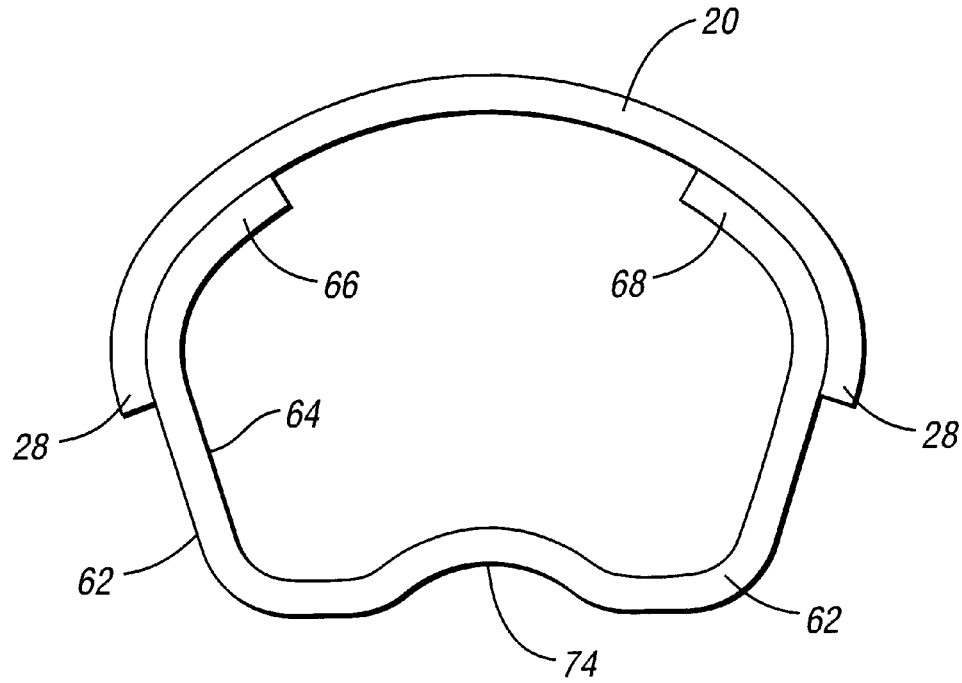
FIG. 5 is a lateral cross-sectional view of the two-piece header of the present invention in which the section lies between two adjacent ferrules.

Referring to FIG. 1, a heat exchanger 1 having two two-piece headers 10 is illustrated. The heat exchanger 1 generally comprises two headers 10 in a spaced apart configuration essentially parallel to each other. Flattened tubes 2 may be attached to the headers 10, which provide a path for heat exchanger fluid to travel from one header to the other header. The flattened tubes 2 are generally made out of metal such as aluminum or copper. The flattened tubes 2 generally support fins 3 made out of metal such as aluminum or copper to further increase the surface area of the heat exchanger and thereby provide for efficient heat exchange. The heat exchanger 1 further generally includes a top plate 4 and a bottom plate 6. The support fins 3 are usually bonded, for example, by brazing, to the adjacent flattened tubes 2 or top or bottom plate 4, 6. The heat exchanger 1 generally comprises at least one inlet 5 and one outlet 7 for the heat exchanger fluid to enter and leave the heat exchanger. Preferably, the ends of the headers 10 have caps 8 or are otherwise closed to contain the heat exchanger fluid therein.

Referring now to FIGS. 2–5, the two-piece header 10 of the present invention comprises an outer elongate member 20 and an inner elongate member 60.

The outer elongate member 20 is preferably roll-formed using known methods from flat stock to a generally U-shaped portion having an outer surface 22 and an inner surface 24. The outer elongate member 20 has first and second ends 26 and 28. The outer elongate member 20 may also be formed in other shapes such as a V-shaped, round, square, or oval without departing from the scope of this invention. The outer elongate member 20 may be formed using other known methods such as extruding, casting, machining, or stamping.

After the outer elongate member 20 is shaped, a plurality of ferrules 30 projecting inwardly from the inner surface 24 are formed in the outer elongate member using, for example, a stamping press having a plurality of stamping dies. The ferrules 30 have openings 32 for communication with flattened tubes (not shown) that transport fluid from one header to another header. Preferably, the ferrules 30 have approximately 45° angled lead-ins. Preferably, the radii around the ferrule openings are approximately 0.03 inches. The ferrules 30 and their respective lead-ins are formed in such a way as to leave clad material in the lead-in and in the ferrule areas for the promotion of leak-resistant brazing.

Alternatively, the outer elongate member 20 may be stamped first and then formed into the desired shape.

Inner elongate member 60 is also preferably roll-formed such that it has a generally U-shaped portion having an outer surface 62 and an inner surface 64. The inner elongate member 60 has first and second ends 66 and 68 which are adapted to cooperate with the first and second ends 26 and 28 of the outer elongate member 20. Proximate at least one of the first and second ends 66, 68, there are a plurality of cut-out portions 70 (FIG. 2) creating a plurality of teeth 72 therebetween. The cut-out portions 70 may be die cut or removed using other known processes such as lasers. Preferably, the cut-out portions 70 and the teeth 72 are present proximate both the first and second ends 66 and 68. The cut-out portions and teeth 70, 72, respectively, are designed to at least partially cooperate with the ferrules 30 of the outer elongate member 20. By nesting the ferrules 30 between the teeth 72, the two-piece header 10 of the present invention is made stronger, leak-resistant, and more durable.

To assemble the two-piece header 10, the first and second ends 66, 68 of the inner elongate member 60 are pressed into the outer elongate member 20 such that the outer surface 62 of the inner member abuts the inner surface 24 of the outer elongate member. Preferably, the elongate members 20 and 60 are designed such that the inner elongate member 60 snaps into the outer elongate member 20 and provides at least some retention strength. Still preferably, there is overlap between the first and second ends 26 and 28 of the outer elongate member 20 and the first and second ends 66 and 68 of the inner elongate member 60. To finally assemble the two-piece header 10, the inner elongate member 20 and the outer elongate member 60 are preferably brazed together in a low-heat operation to prevent distortion. Other means of securing the members together, such as welding and spot welding, may also be used.

Although the outer and inner elongate members 20, 60 are shown as generally U-shaped portions, and the final assembled two-piece header 10 shown as generally having an oval cross-section, the inner and outer elongate members may be shaped otherwise.

The panel 74 of the inner elongate member 60 may comprise a concave surface such that the two-piece header 10 has a smaller volume and therefore requires less fluid to occupy the header. Further, the inner elongate member 60 may have one or more flats 78 (FIG. 2) on the outer surface 62 to positively locate the header in subsequent manufacturing steps.

The back panel 74 of the inner elongate member 60 may have one or more connector tube openings 80 to accommodate or support fluid passages, such as inlet 5 and outlet 7, to permit entry and exit of fluid into the heat exchanger.

End caps 8 may be provided on the headers to contain the heat exchanger fluid.

Preferably, each member is manufactured out of a flat piece of metal. More preferably, each member is initially a flat piece of clad aluminum which is about 0.05 to 0.08 inch thick. The cladding helps ensure good brazing between the members to improve strength and minimize leakage. The members may be cut to the proper length either before or after forming.

In an alternate embodiment, the ends 66, 68 may be conformed so that they lie outside the ends 26, 28 and the ferrules 30 may project outwardly rather than inwardly.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A heat exchanger comprising:

first and second two-piece headers, each header having an outer elongate member with a curved lateral section and having a plurality of ferrules projecting inwardly and an inner elongate member adapted to mate with the outer elongate member, the inner elongate member having first and second ends, the inner elongate member having a plurality of teeth proximate the at least one of the first and second ends that at least partially cooperate with the ferrules when the outer elongate member engages the inner elongate member;

a plurality of tubes that extend between respective ferrules in the headers to provide a path for fluid to travel from one header to the other header; and a plurality of fins bonded to at least some of the tubes to increase the heat exchange capability of the heat exchanger.

2. The heat exchanger of claim 1 wherein the outer elongate member has an inner surface and the inner elongate member has an outer surface and wherein at least a portion of the inner surface of the outer elongate member interfaces with at least a portion of the outer surface of the inner elongate member to provide a strong, leak-resistant union.

3. The heat exchanger of claim 1 wherein the inner and outer elongate members are manufactured from clad aluminum.

4. The heat exchanger of claim 1 wherein the header has a generally oval cross-section.

5. The heat exchanger of claim 1 wherein the inner elongate member has a concave back wall to decrease the volume of the header.

6. The heat exchanger of claim 1 wherein the ferrules have angled lead-ins.

7. The heat exchanger of claim 1 wherein the inner and outer elongate members are generally U-shaped.

8. The heat exchanger of claim 1 wherein the first and second elongate members are brazed together.

9. The heat exchanger of claim 1 wherein the inner elongate member has a plurality of teeth proximate both the first and second ends.

10. A header for a heat exchanger, the header comprising:

an outer elongate member with a curved lateral section and having a plurality of ferrules projecting inwardly; and an inner elongate member adapted to mate with the outer elongate member, the inner elongate member having first and second ends, the inner elongate member having a plurality of teeth proximate at least one of the first and second ends that at least partially cooperate with the ferrules when the outer elongate member engages the inner elongate member.

11. The header of claim 10 wherein the outer elongate member has an inner surface and the inner elongate member has an outer surface and wherein at least a portion of the inner surface of the outer elongate member interfaces with at least a portion of the outer surface of the inner elongate member to provide a strong, leak-resistant union.

12. The header of claim 10 wherein the inner and outer elongate members are manufactured from clad aluminum.

13. The header of claim 10 wherein the header has a generally oval cross-section.

14. The header of claim 10 wherein the inner elongate member has a concave back wall to decrease the volume of the header.

15. The header of claim 10 wherein the inner elongate member has at least one flat portion to facilitate positive locating.

16. The header of claim 10 wherein the ferrules have angled lead-ins.

17. The header of claim 10 wherein the inner and outer elongate members are generally U-shaped.

18. The header of claim 10 wherein the first and second elongate members are brazed together.

19. The header of claim 10 wherein the first and second elongate members are designed to snap fit together.

20. The header of claim 10 wherein the inner elongate member has a plurality of teeth proximate both the first and second ends.

* * * * *